US005470249A

United States Patent [19]

Manganello

[11] Patent Number: 5,470,249

[45] Date of Patent: Nov. 28, 1995

[54] ELECTRICAL POWER CORD RETAINING CONNECTOR

[76] Inventor: Robert D. Manganello, 18 Crestview Dr., Dallas, Pa. 18612-9114

[21] Appl. No.: 337,113

[22] Filed: Nov. 10, 1994

[51] Int. Cl.[6] ..... H01R 13/62

[52] U.S. Cl. ..... 439/369; 439/368

[58] Field of Search ..... 439/360, 361, 439/362, 363, 364, 365, 366, 368, 369, 370; 24/129 A, 131 C

[56] References Cited

U.S. PATENT DOCUMENTS

| | | | |
|---|---|---|---|
| 2,721,313 | 10/1955 | English | 439/369 |
| 3,041,571 | 6/1962 | Friend et al. | 439/366 |
| 3,097,034 | 7/1963 | Tanarosy | 439/370 |

FOREIGN PATENT DOCUMENTS

| | | | |
|---|---|---|---|
| 0130295 | 11/1928 | Germany | 24/131 C |

*Primary Examiner*—Larry I. Schwartz
*Assistant Examiner*—Hien D. Vu

[57] ABSTRACT

An electrical cord retaining connector for maintaining the plug ends of two interconnected cords in a mated position comprising an elongated piece of flexible wire having free ends and an intermediate portion therebetween, the free ends each having a helical coil formed thereon, the intermediate portion further having a helical coil formed thereon and thereby creating a pair of segments extended outwardly therefrom to the coils at the free ends and with the piece positionable in a coupled configuration between two interconnected cords having mated plug ends with the coil on the intermediate portion securable about one cord near a plug end thereof and the coils at the free ends positionable in coaxial alignment about the other cord near a plug end thereof whereby the piece ensures that the plug ends remain in their mated configuration.

1 Claim, 4 Drawing Sheets

ELECTRICAL POWER CORD RETAINING CONNECTOR

BACKGROUND OF THE INVENTION

1. Field of the Invention

The present invention relates to an electrical power cord retaining connector and more particularly pertains to holding the male and female plug ends of two interconnected electrical power cords in a mated position for ensuring transfer of electrical power therethrough with an electrical power cord retaining connector.

2. Description of the Prior Art

The use of cord coupling devises is known in the prior art. More specifically, cord coupling devises heretofore devised and utilized for the purpose of securing the ends of cords together are known to consist basically of familiar, expected and obvious structural configurations, notwithstanding the myriad of designs encompassed by the crowded prior art which have been developed for the fulfillment of countless objectives and requirements.

By way of example, U.S. Pat. No. 4,169,643 to Gallagher discloses an electrical connector mating clip. U.S. Pat. No. 4,206,961 to Cifalde discloses an extension cord clip. U.S. Pat. No. 4,643,505 to House et al. discloses an extension cord connector housing. U.S. Pat. No. 5,104,335 to Conley discloses an electrical cord connector and retainer. U.S. Pat. No. 5,129,839 to Van Skiver discloses a extension cord connection housing.

While these devices fulfill their respective, particular objective and requirements, the aforementioned patents do not describe an electrical power cord retaining connector that is simple in design and allows the plug ends of two interconnected power cables to remain in their mated position.

In this respect, the electrical power cord retaining connector according to the present invention substantially departs from the conventional concepts and designs of the prior art, and in doing so provides an apparatus primarily developed for the purpose of holding the male and female plug ends of two interconnected electrical power cords in a mated position for ensuring transfer of electrical power therethrough.

Therefore, it can be appreciated that there exists a continuing need for new and improved electrical power cord retaining connector which can be used for holding the male and female plug ends of two interconnected electrical power cords in a mated position for ensuring transfer of electrical power therethrough. In this regard, the present invention substantially fulfills this need.

SUMMARY OF THE INVENTION

In the view of the foregoing disadvantages inherent in the known types of cord coupling devises now present in the prior art, the present invention provides an improved electrical power cord retaining connector. As such, the general purpose of the present invention, which will be described subsequently in greater detail, is to provide a new and improved electrical power cord retaining connector and method which has all the advantages of the prior art and none of the disadvantages.

To attain this, the present invention essentially comprises an elongated piece of flexible metal wire coated with a plastic sheath. The piece has free ends and an intermediate portion therebetween. The free ends each further have a helical coil of two complete turns formed thereon. The intermediate portion further has a helical coil of three complete turns formed thereon. The intermediate coil thereby creates a pair of segments extended outwardly at diametric locations thereon to the coils at the free ends. The piece is positionable in a generally linear decoupled configuration with the segments colinearly aligned and the coils coaxially aligned. The piece is further positionable in a coupled configuration between two electrical power cords interconnected by mated male and female plug ends with the coil on the intermediate portion securable about one electrical power cord near its female plug end and the coils at the free ends positionable in coaxial alignment about the other electrical power cord near its male plug end, whereby the piece ensures that the plug ends remain in their mated position.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved electrical power cord retaining connector which has all the advantages of the prior art cord coupling devises and none of the disadvantages.

It is another object of the present invention to provide a new and improved electrical power cord retaining connector which may be easily and efficiently manufactured and marketed.

It is a further object of the present invention to provide a new and improved electrical power cord retaining connector which is of durable and reliable construction.

An even further object of the present invention is to provide a new and improved electrical power cord retaining connector which is susceptible of a low cost of manufacture with regard to both materials and labor, and which accordingly is then susceptible of low prices of sale to the consuming public, thereby making such an electrical power cord retaining connector economically available to the buying public.

Still yet another object of the present invention is to provide a new and improved electrical power cord retaining connector which provides in the .apparatuses and methods of the prior art some of the advantages thereof, while simultaneously overcoming some of the disadvantages normally associated therewith.

Even still another object of the present invention is to provide a new and improved electrical power cord retaining connector for holding the male and female plug ends of two interconnected electrical power cords in a mated position for ensuring transfer of electrical power therethrough.

Lastly, it is an object of the present invention to provide a new and improved electrical power cord retaining connector comprising an elongated piece of flexible wire having free ends and an intermediate portion therebetween, the free ends each having a helical coil formed thereon, the intermediate portion further having a helical coil formed thereon and thereby creating a pair of segments extended outwardly therefrom to the coils at the free ends and with the piece positionable in a coupled configuration between two interconnected cords having mated plug ends with the coil on the intermediate portion securable about one cord near a plug end thereof and the coils at the free ends positionable in coaxial alignment about the other cord near a plug end thereof whereby the piece ensures that the plug ends remain in their mated configuration.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various Figures.

DESCRIPTION OF THE PREFERRED EMBODIMENT

Figure 1:
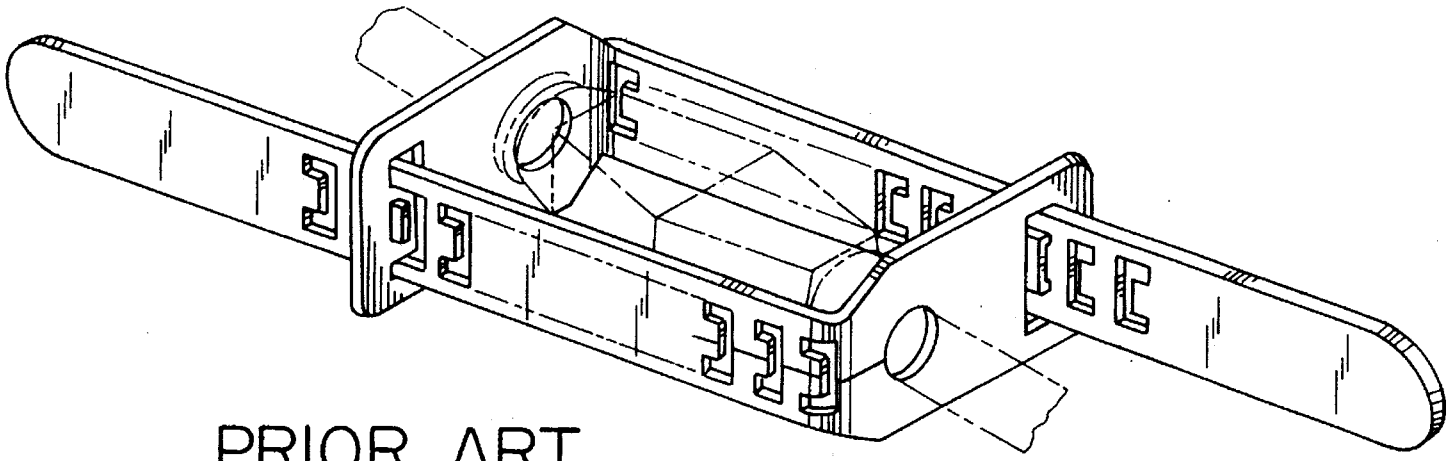
PRIOR ART FIG. 1
FIG. 1 is a perspective view of a prior art electrical cord connector and retainer.
Figure 2:
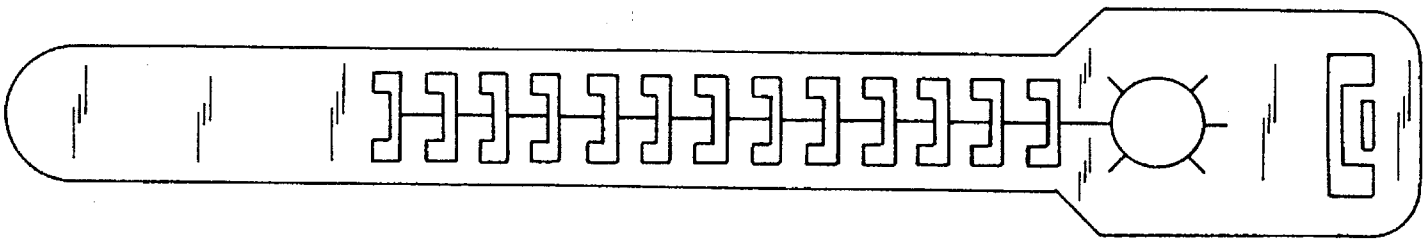
PRIOR ART FIG. 2
FIG. 2 is a side-elevational view of yet another prior art electrical cord connector.
Figure 3:
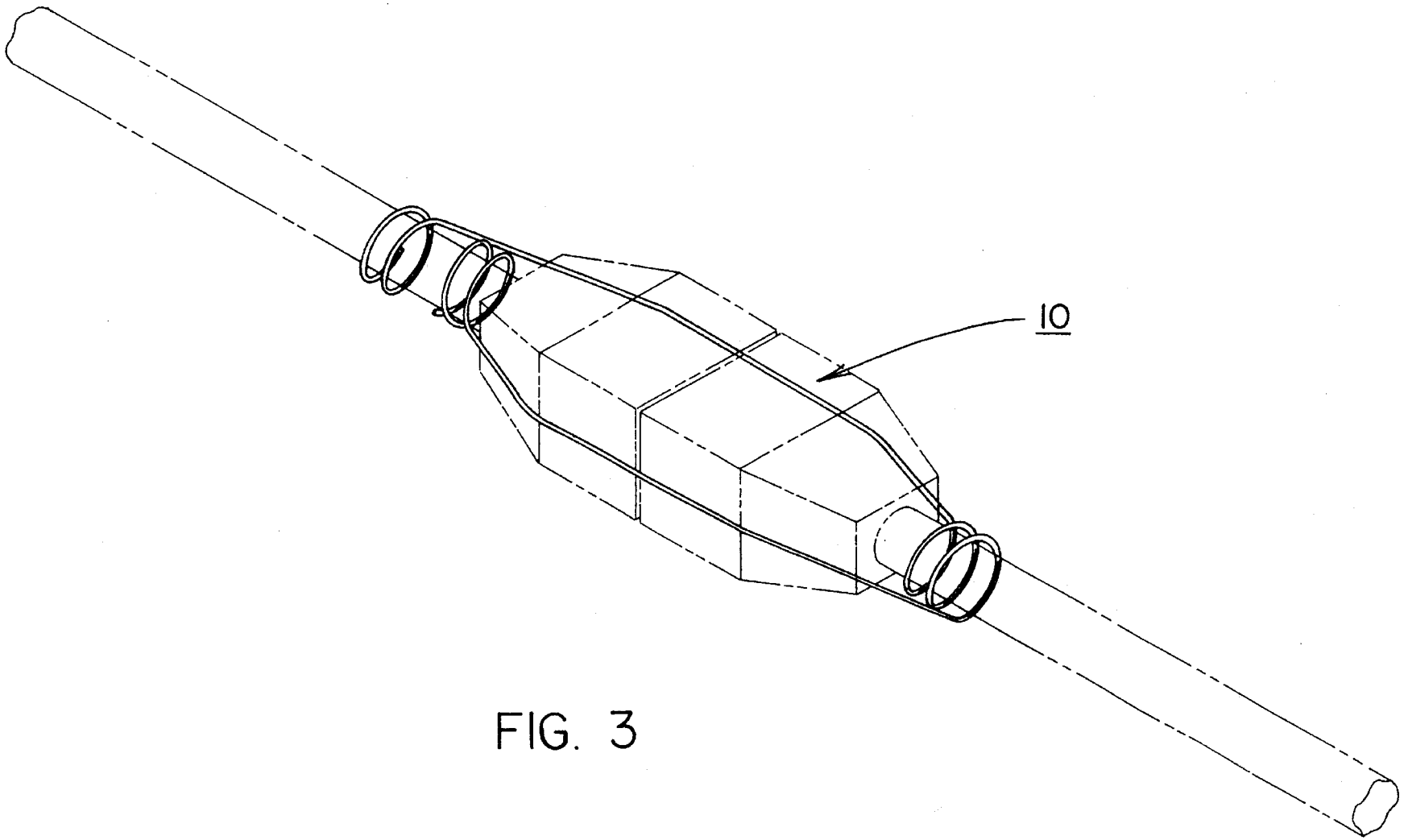
FIG. 3 is a perspective view of the preferred embodiment constructed in accordance with the principles of the present invention secured about two electrical power cords near their mated plug ends.
Figure 4:
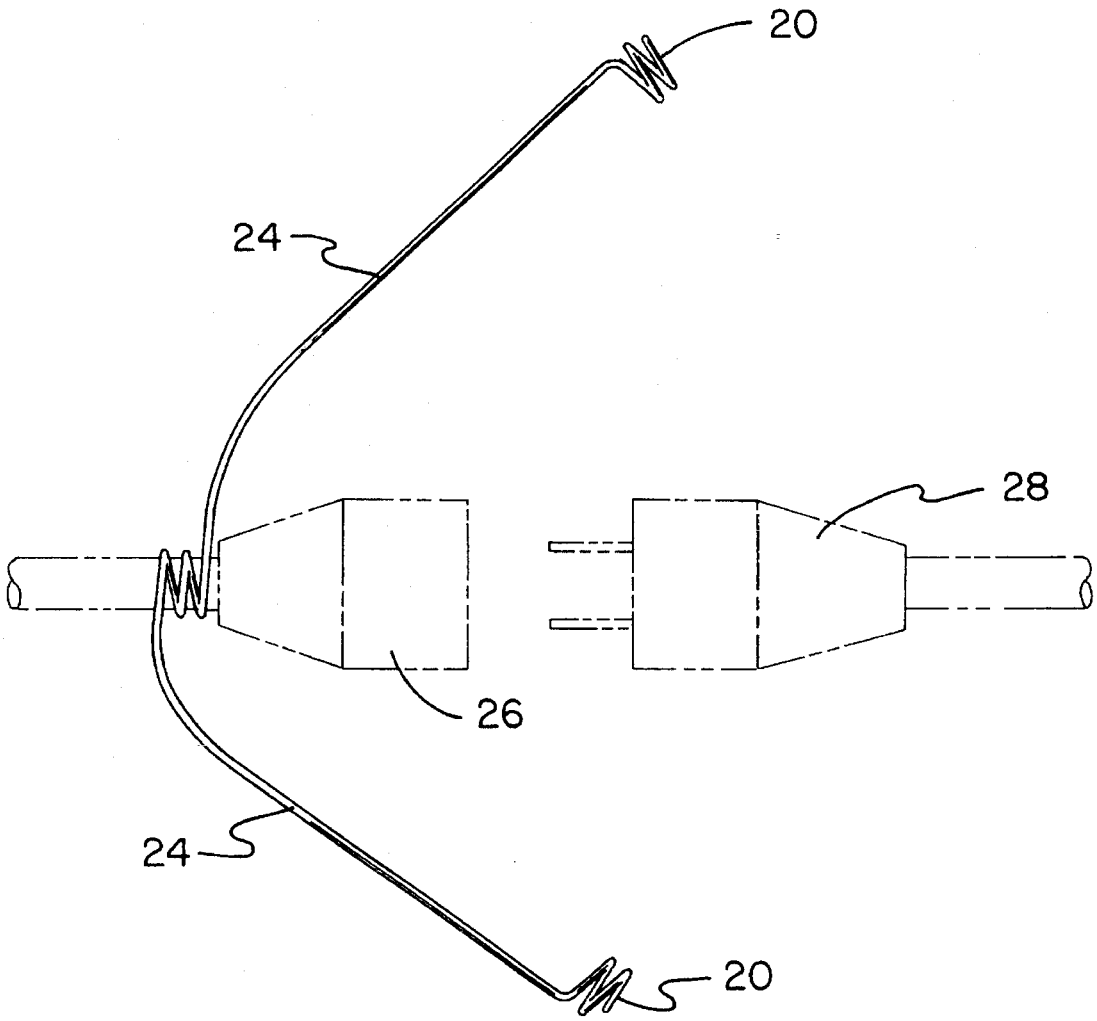
FIG. 4 is a plan view of the present invention secured about the female plug end of an electrical power cord and in a position for securement with a male plug end of another electrical power cord.
Figure 5:
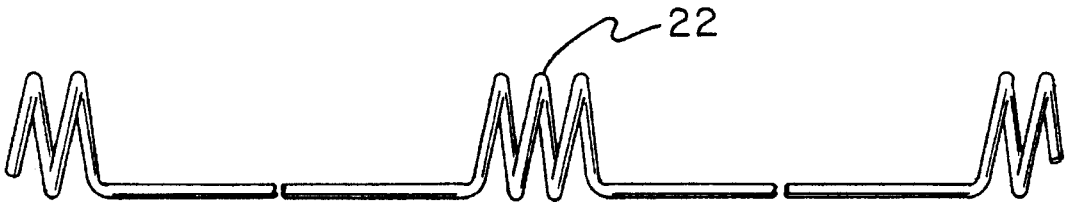
FIG. 5 is a side-elevational view of the present invention decoupled from electrical power cords.
Figure 6:
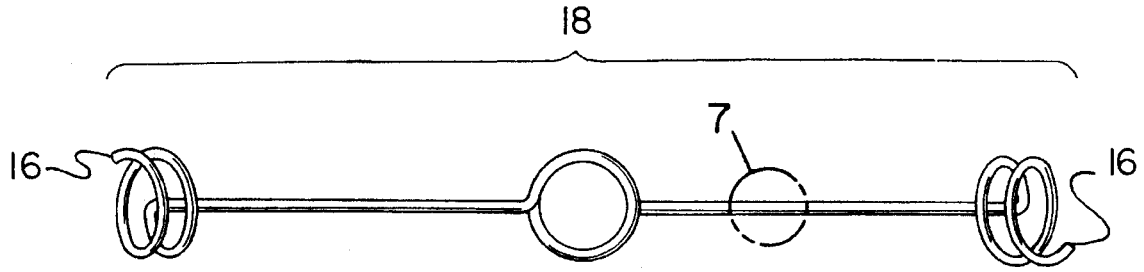
FIG. 6 is yet another side-elevational view of the present invention as viewed axially down along the electrical power cable with the male plug end in FIG. 4.
Figure 7:
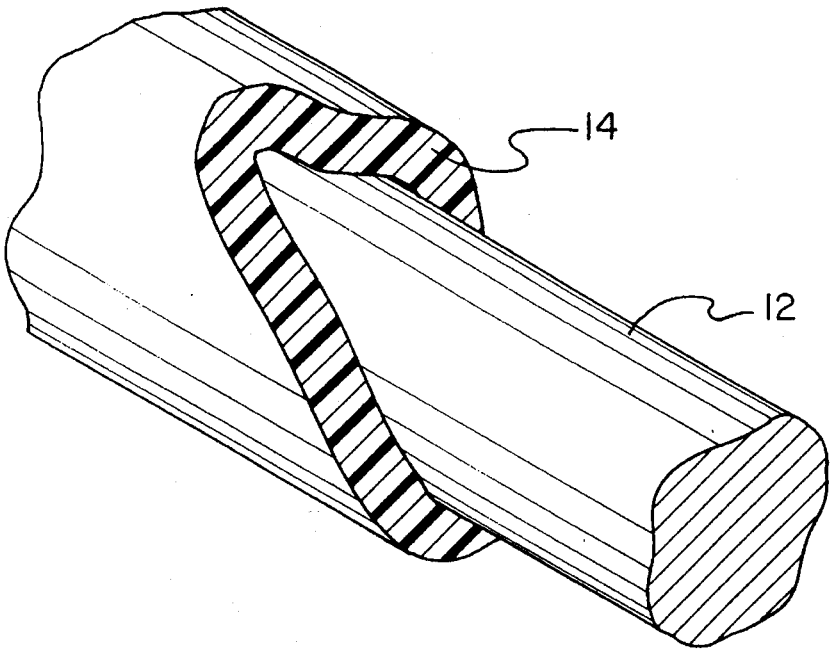
FIG. 7 is an enlarged perspective and cross-sectional view of a portion of the prevent invention of FIG. 6 depicting the association of the sheath and wire.

With reference now to the drawings, and in particular, to FIGS. 3 through 5 thereof, the preferred embodiment of the new and improved electrical power cord retaining connector embodying the principles and concepts of the present invention and generally designated by the reference number 10 will be described.

Specifically, the present invention is used to hold the male and female plug ends of two interconnected electrical power cords in a mated position. The present invention ensures that the plug ends are held in a coupled configuration for transfer of electrical power therethrough. Specifically, the present invention consists of an elongated piece of flexible metal wire 12 coated with a plastic sheath or a sheath of some other non-conductive variety. The piece has free ends 16 and an intermediate portion 18 therebetween. The free ends each have a helical coil 20 formed thereon. Each coil on a free end is formed with two complete turns. This configuration allows the coils to be securely coupled to an electrical power cable and yet decoupled readily. The intermediate portion of the piece has a helical coil 22 formed thereon. This coil on the intermediate portion is formed of three complete turns. This configuration also allows the coil to be securely coupled to an electrical power cable and yet decoupled readily. The coil on the intermediate portion incorporates another turn to provide extra stability in supporting the coils at the free ends. The intermediate coil and its relative positioning on the piece creates a pair of segments 24. The segments are extended outwardly from the coil on the intermediate portion at diametric locations thereon to the coils at the free ends. The piece is positionable in a generally linear when not secured between two electrical power cords to define a decoupled configuration. In the de-coupled configuration, the segments are colinearly aligned and the coils are coaxially aligned as shown in FIG. 5. The piece is further positionable in a coupled configuration between two electrical power cords that are interconnected by mated male and female plug ends. In the coupled configuration, the coil 22 on the intermediate portion is securable about one electrical power cord near its female plug end 26 and the coils 20 at the free ends are positionable about the other electrical power cord near its male plug end 28. The coils at the free ends are in co-axial alignment about the associated electrical power cord. When secured around the electrical power cords in this fashion, the piece insures that the plug ends remain in their mated position as shown in FIG. 3.

The present invention is an extension cord attachment which wraps around the electrical power cords and connects their plug ends to prevent the two plugs from becoming detached during use. The present invention is manufactured from a sturdy wire. The present invention features a durable plastic coating. The two free ends of the present invention are coiled twice while their center coil is turned approximately three times. This simple device will accommodate any size cord including thicker ones often found on power tools or heavy appliances. The length of the wire of the present invention could be formed with various sizes to fit any size plug or plugs.

The coiled center area of the present invention is wrapped around the female end of an electrical extension cord at a location close to its plug, the male end of a power tool or other electrical device is then plugged into the extension cord. The coils at the free ends of the wire are then bent around the cord of the power tool or electrical device and then securely twisted into place. Once connected with both electrical cords, the present invention prevents them from becoming separated during use. To disconnect the two cords, the coils of the present invention are simply untwisted from the cord of the male end while the female end, attached to the extension cord, remains in place for future use. The present invention saves time and aggravation by keeping the electrical cords coupled together and eliminates untimely and sometimes dangerous plug separation.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modification and changes will readily occur to those skilled in the art, it is not desired to limit the invention to the exact construction and operation shown and described, and accordingly, all suitable modification and equivalents may be resorted to, falling within the scope of the invention.

What is claimed as being new and desired to be protected by Letters Patent of the United States is as follows:

1. An electrical cord retaining connector holding the male and female plug ends of two interconnected electrical power cords in a mated position for ensuring transfer of electrical power therethrough comprising:

an elongated piece of flexible metal wire coated with a plastic sheath, the elongated piece having free ends and an intermediate portion therebetween, the free ends each further having a first helical coil of two complete turns formed thereon, the intermediate portion further having a second helical coil of three complete turns and a pair of straight non-coiled segments extending outwardly with respect to the ends thereof to the first coils at the free ends, the elongated piece positionable in a generally linear decoupled configuration with the segments colinearly aligned and the first and second helical coils coaxially aligned, the elongated piece further positionable in a coupled configuration between two electrical power cords interconnected by the mated male and female plug ends with the second coil on the intermediate portion securable about one electrical power cord near the female plug end and the first coils at the free ends positionable in coaxial alignment about the other electrical power cord near the male plug end whereby the elongated piece ensures that the plug ends remain in their mated position.

* * * * *